US008230686B2

(12) United States Patent
Banas et al.

(10) Patent No.: US 8,230,686 B2
(45) Date of Patent: Jul. 31, 2012

(54) START-UP SYSTEM MIXING SPHERE

(76) Inventors: John M. Banas, Warren, MA (US); Vincent J. Costa, Southwick, MA (US)

( * ) Notice: Subject to any disclaimer, the term of this patent is extended or adjusted under 35 U.S.C. 154(b) by 697 days.

(21) Appl. No.: 12/248,452

(22) Filed: Oct. 9, 2008

(65) Prior Publication Data

US 2010/0089061 A1 Apr. 15, 2010

(51) Int. Cl.
*F01K 13/02* (2006.01)

(52) U.S. Cl. ..... 60/646; 60/649; 60/657

(58) Field of Classification Search ..... 60/646, 60/649, 657
See application file for complete search history.

(56) References Cited

U.S. PATENT DOCUMENTS

| | | | | |
|---|---|---|---|---|
| 3,125,994 | A | 3/1964 | Koch | |
| 3,135,096 | A | 6/1964 | Schroedter | |
| 5,188,962 | A * | 2/1993 | Hasegawa et al. | 435/297.4 |
| 5,264,056 | A * | 11/1993 | Lapides | 148/713 |
| 6,401,667 | B2 | 6/2002 | Liebig | |
| 6,874,322 | B2 * | 4/2005 | Schwarzott | 60/772 |
| 2006/0070586 | A1 | 4/2006 | Dague | |
| 2006/0150614 | A1 * | 7/2006 | Cummings | 60/275 |

FOREIGN PATENT DOCUMENTS

| | | | |
|---|---|---|---|
| DE | 4310009 | A1 | 9/1994 |
| EP | 1193373 | A1 | 4/2002 |
| FR | 610409 | | 9/1926 |
| WO | WO 2008/110776 | A2 | 9/2008 |

OTHER PUBLICATIONS

PCT International Search Report and the Written Opinion of the International Searching Authority dated Aug. 12, 2010—(PCT/US2009/059351).

* cited by examiner

*Primary Examiner* — Hoang Nguyen
(74) *Attorney, Agent, or Firm* — Lawrence P. Zale

(57) ABSTRACT

A start-up system mixing element including; a body defining a cavity, a first inlet port disposed in the body and configured to provide a first fluid to the cavity, a second inlet port disposed in the body and configured to provide a second fluid to the cavity, an outlet port disposed in the body and configured to remove the first and second fluids from the cavity and an internal distribution pipe disposed in the first inlet port, wherein the internal distribution pipe is configured to provide the first fluid to the cavity via a plurality of holes directed toward a center of the cavity.

17 Claims, 3 Drawing Sheets

START-UP SYSTEM MIXING SPHERE

TECHNICAL FIELD

This application relates generally to an apparatus for mixing flow streams of different temperatures in a power plant and a method of operating the same, and more particularly, to a mixing sphere in a start-up system of a power plant.

BACKGROUND

Plants in which a liquid medium passes through a plurality of thermal systems in order to be heated, possibly evaporated, are present, for example, in boilers which are heated by flue gas from burners or exhaust gas from gas turbines.

The medium may be water, having additives if need be. Depending on the final boiler load, the water is heated in the boiler to a predetermined temperature in order to be fed, for example, to an industrial plant, a hot-water network, etc., or evaporated in order to be fed, for example, to a steam turbine or an industrial steam load.

The first thermal system in the boiler of such a plant is normally called an economizer, and may include a first heat exchanger and a heating-area bank. Due to temperature conditions, the economizer, which is provided for the cooling of the flue gas and preheating feed-water to be introduced into the boiler by a boiler inlet, preferably works on the flue-gas-side or exhaust-gas-side end of the boiler, e.g., at comparatively low temperatures when compared to the temperatures in the boiler itself.

On the other hand, the temperature difference between the flue gas or exhaust gas and the feed-water to be heated is relatively small. This in turn results in large heating areas and large heating-area masses associated therewith. Furthermore, it is known that there is a risk of dew-point corrosion on account of the temperatures and pressures prevailing in the economizer.

Known methods of raising the feed-water temperature at the boiler inlet and for avoiding dew point corrosion within the economizer include recirculation wherein water preheated by the boiler is admixed with the feed-water. Power plants utilizing recirculation may do so throughout all of the various operating loads under which they operate, or they may selectively recirculate the feed-water so that recirculation is only utilized at start-up and/or low operating loads.

A power plant utilizing recirculation may include a pumped start-up system used at start-up and at low operating loads, e.g., conditions where the feedwater flow is not of sufficient quantity to protect the waterwall tubes from overheating due to the combustion of fuel taking place in the boiler furnace. Such a power plant may include a main bypass line that diverts incoming feed-water from a main feed-water line to a mixing device wherein the feed-water is mixed with recirculated water previously heated by the boiler. The recirculated water heats the feed-water in the mixing device and then the mixed feed-water is pumped to an economizer feed-water line downstream of the bypass line and is eventually supplied to the economizer. The mixing device must be relatively large in order to handle a flow rate of 30% to 40% of full operational load.

Once the power plant reaches a particular operating load, the feedwater flow is of sufficient quantity to protect the waterwall tubes from overheating and exhaust gas temperatures increase to a point where the economizer may operate optimally without pre-heating the feed-water by recirculation. When the power plant reaches such operating conditions, the flow of feed-water to the main bypass line is stopped. The power plant may then operate in a once-through mode wherein feed-water is not recirculated.

When the power plant is in the recirculation mode, the mixing device must mix the saturated, recirculated water with the relatively cold feed-water without generating excessive thermal stress in the mixing device or in subsequent components downstream of the mixing device. The mixing device must also contain a mechanism for preventing debris from reaching the downstream components of the power plant, particularly a circulation pump used for pumping the mixed feed-water back to the main feed-water line.

Typically, the mixing of the saturated recirculated water with the relatively cold feed-water is performed in a drum-type unit having sleeved nozzles. In once through boilers the mixing process is accomplished by a mixing tee. The mixing tee includes an outer pipe having a first diameter for transporting the cold feed-water and an inner pipe having a second smaller diameter for transporting the saturated, recirculated water. The inner pipe contains a series of holes around its circumference and along its length to allow for mixing of the two liquids.

However, the mixing tee has several drawbacks. Firstly, the inner pipe is inaccessible for inspection, cleaning or repair. Thus, if a defect is suspected, the entire assembly must be disassembled to inspect, thereby causing an increase in plant downtime for maintenance. Secondly, the mixing tee is difficult to construct and install; the relatively small spacing between the pipes leaves little room for error and is relatively complex to assemble. Therefore, construction costs are increased and replacement of the mixing tee is a complicated procedure leading to additional plant downtime. In addition, the mixing tee must be used in conjunction with a sieve for debris removal. The sieve is a complex combination of perforated plates and screens, and typically requires a pressure seal cover which is expensive, difficult to maintain and prone to scoring and leaks. Furthermore, the mixing tee and sieve are formed as two separate pressure parts.

What is needed is a mixing device which combines mixing and filtering elements in a single pressure part and which is easy to construct, install, inspect, maintain and replace.

SUMMARY

According to the aspects illustrated herein, there is provided a start-up system mixing element including; a body defining a cavity, a first inlet port disposed in the body and configured to provide a first fluid to the cavity, a second inlet port disposed in the body and configured to provide a second fluid to the cavity, an outlet port disposed in the body and configured to remove the first and second fluids from the cavity and an internal distribution pipe disposed in the first inlet port, wherein the internal distribution pipe is configured to provide the first fluid to the cavity via a plurality of holes directed toward a center of the cavity. Filtering capability is installed at the outlet port.

According to other aspects illustrated herein, a power plant includes; a main feed-water line, a main bypass line connected to the main feed-water line, an economizer feed-water line connected to the main feed-water line, an economizer connected to the economizer feed-water line, a plurality of waterwalls connected to the economizer, a separator connected to the waterwalls and configured to separate liquids from steam, a recirculation water line connected to the separator and configured to receive liquids therefrom, a start-up system mixing element connected to the main bypass line and the recirculation water line, a mixed feed-water line connected to the start-up system mixing element and the economizer feed-water line; and a circulation pump disposed along the mixed feed-water line between the start-up system mixing element and the economizer feed-water line, wherein the start-up system mixing element includes; a body defining a cavity, a first inlet port disposed in the body and configured to receive a first fluid from the main bypass line and provide the first fluid to the cavity, a second inlet port disposed in the body and configured to receive a second fluid from the recirculation water line and provide the second fluid to the cavity, an outlet port disposed in the body and configured to remove the first and second fluids from the cavity and an internal distribution pipe disposed in the first inlet port, wherein the internal distribution pipe is configured to provide the first fluid to the cavity via a plurality of holes directed toward a center of the cavity.

According to other aspects illustrated herein, a method for mixing and filtering two fluids, the method includes; providing a body defining a cavity, providing a first fluid to the cavity via a first inlet port disposed in the body, providing a second fluid to the cavity via a second inlet port disposed in the body, mixing the first and second fluids in the center of the cavity before the fluids contact the body, and filtering the mixed first and second fluids through a filter before exiting the outlet port.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Disclosed herein are an apparatus for mixing flow streams of different temperatures in a power plant and a method of operating the same, and more particularly, to a mixing sphere in a start-up system of a power plant.

Figure 1:
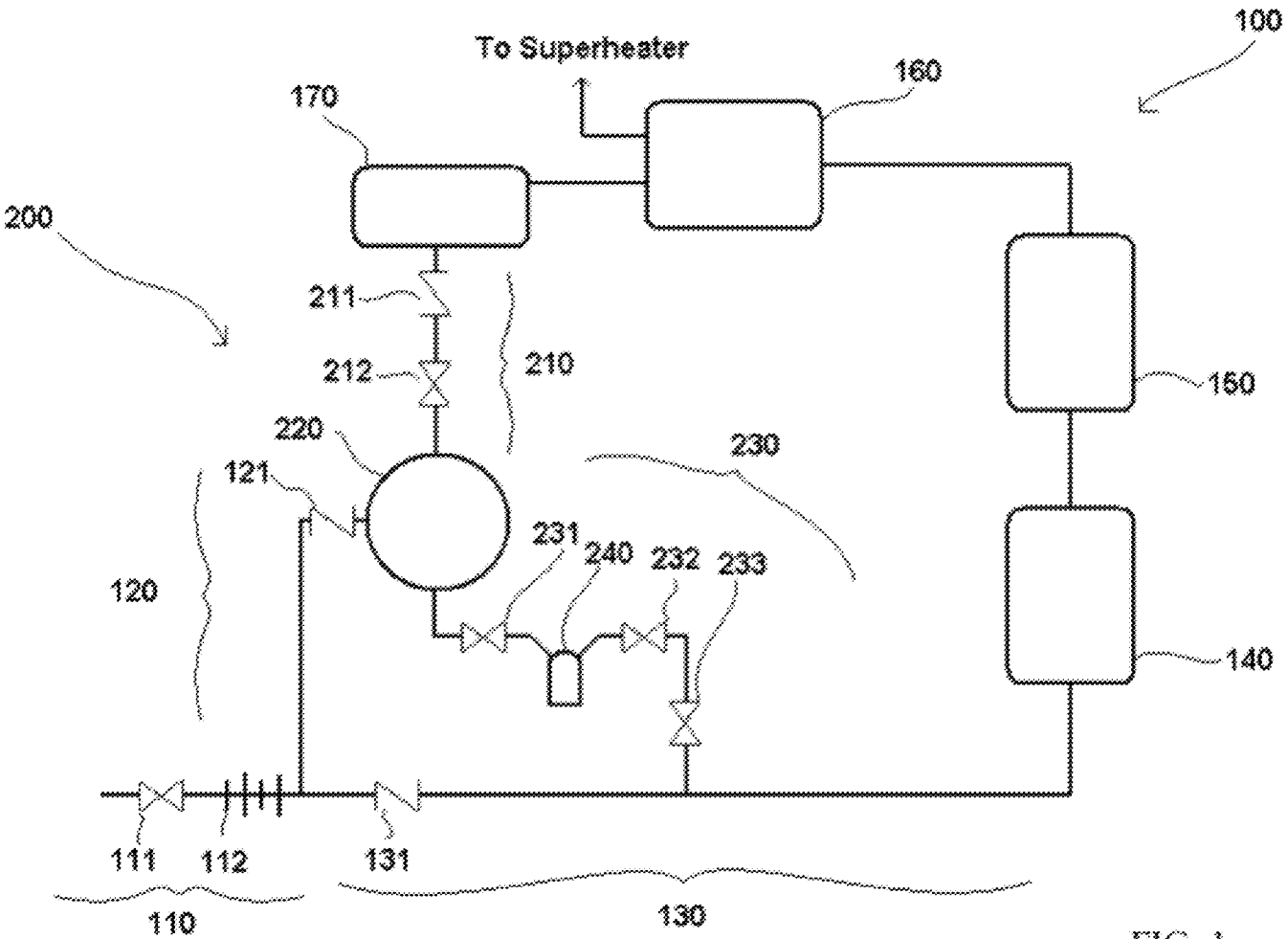
FIG. 1 is a schematic view of a power plant including a recirculation system according to an exemplary embodiment of the present invention.

FIG. 1 is a schematic view of a power plant 100 including a start-up system 200 to pre-heat incoming feed-water during start-up and low-operating load conditions according to an exemplary embodiment of the present invention.

Referring to FIG. 1, in the current exemplary embodiment, a main feed water line 110 which supplies feed-water to the power plant 100. The feed-water may be water which has not been previously used in the power plant 100 or it may be water which has been previously used, but has been allowed to condense and cool before being reintroduced into the feed-water line 110. Various flow control devices may be included along the length of the feed-water line 110. In one exemplary embodiment, a stop valve 111 may be installed upstream of an isolation valve 112 in the main feed-water line 110.

The power plant 100 also includes a main bypass line 120 connected to the main feed-water line 110 downstream of the isolation valve 112. In one exemplary embodiment, the main bypass line 120 may be connected to the main feed-water line 110 by a T-shaped intersection. However, alternative exemplary embodiments include configurations wherein the main bypass line 120 is connected to the main feed-water line 110 by other connections as known in the art. In one exemplary embodiment, the main bypass line 120 includes an inlet check valve 121 along its length. The main bypass line 120 will be discussed in more detail below with respect to a recirculation cycle.

The power plant 100 also includes an economizer feed-water line 130 connected to the main feed-water line 110 downstream of the intersection between the main feed-water line 110 and the main bypass line 120. In one exemplary embodiment, the economizer feed-water line 130 includes a check valve 131 along its length.

An economizer 140 is connected to an end of the economizer feed-water line 130. The economizer 140 is typically located in a backpass of the power plant 100 and is exposed to high temperature exhaust gasses produced by a boiler furnace (not shown). The economizer 140 may include any of various configurations as would be known to one of ordinary skill in the art.

The economizer 140 is connected to waterwalls 150. The waterwalls 150 are typically located within the boiler of the power plant 100. The waterwalls 150 are designed to withstand extremely high temperatures and pressures and is typically where the power plant converts water into steam as will be described in more detail below.

The waterwalls 150 are connected to a separator 160. The separator 160 is configured to separate liquid water from steam. In one exemplary embodiment, the separator 160 may include a plurality of individual separation units (not shown), however, the separator 160 may include any of various configurations as would be known to one of ordinary skill in the art. The separator 160 is configured such that steam may flow through a connection to a superheater and liquid water may flow through a connection to a storage tank 170. In alternative exemplary embodiments the storage tank 170 may be included as a portion of the separator.

In the current exemplary embodiment, the storage tank 170 is connected to the start up system 200 via a recirculation water line 210. In one exemplary embodiment, the recirculation water line 210 may include a recirculation check valve 211 and a recirculation stop valve 212. Although the start-up system 200 as described herein includes elements downstream of the storage tank 170 and the separator 160, one of ordinary skill in the art would appreciate that in alternative exemplary embodiments the separator 160 and storage tank 170 may also be considered components of the start-up system 200.

Figure 2:
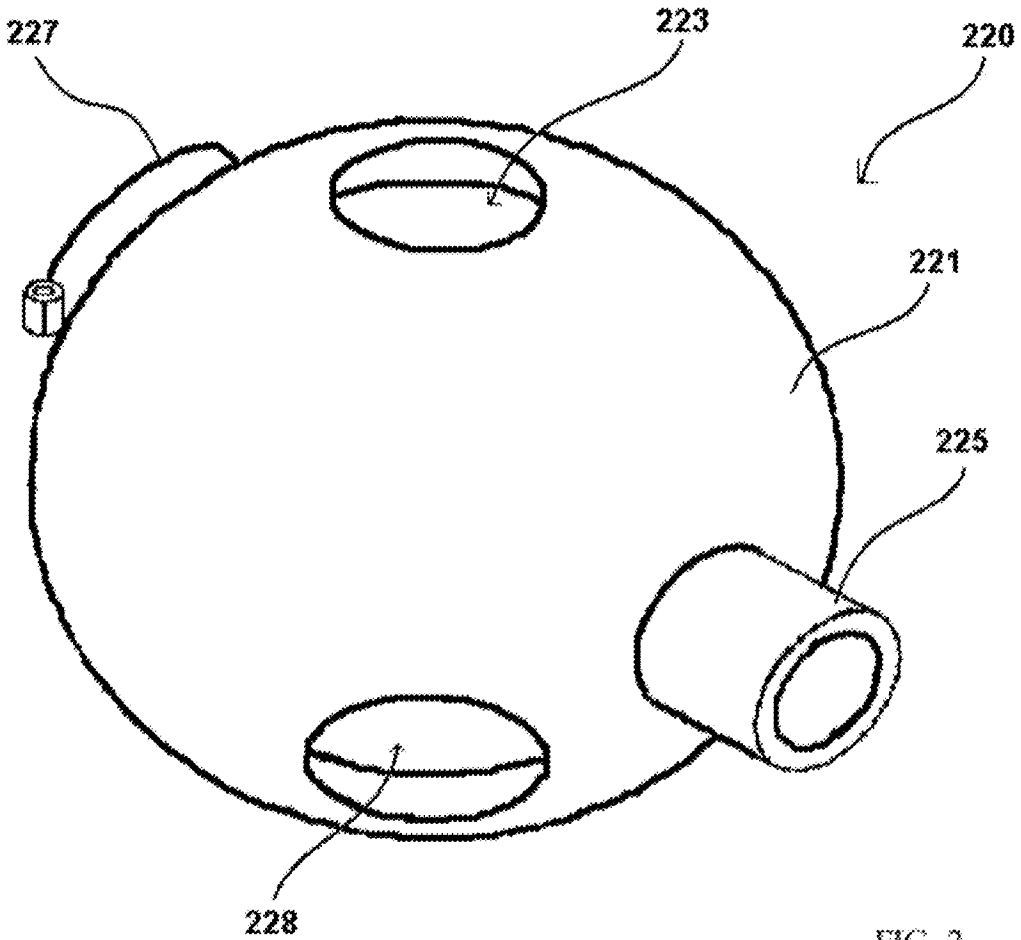
FIG. 2 is a front perspective view of a mixing element according to an exemplary embodiment of the present invention.
Figure 3:
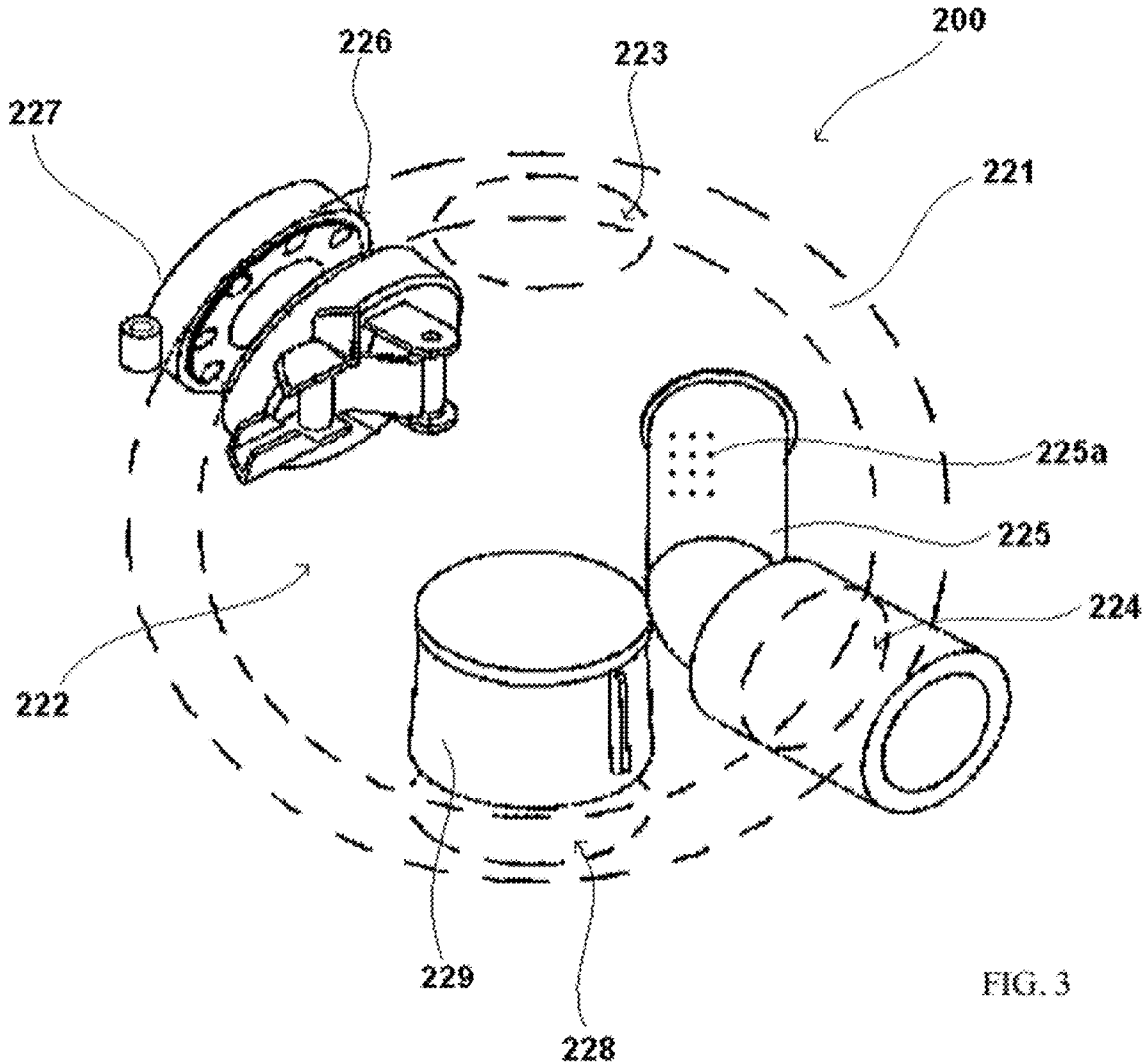
FIG. 3 is partial schematic view of the mixing element of FIG. 2 including a front perspective view of elements contained therein according to an exemplary embodiment of the present invention.

FIG. 2 is a front perspective view of a mixing element 220 according to an exemplary embodiment and FIG. 3 is partial schematic view of the mixing element of FIG. 2 including a front perspective view of elements contained therein according to an exemplary embodiment. Referring now to FIGS. 1-3, the recirculation water line 210 is connected to the start-up system mixing element 220. In one exemplary embodiment the start-up system mixing element includes a spherical body 221 having an internal cavity 222. In one exemplary embodiment, the spherical body 221 may be formed as a single unitary and indivisible pressure vessel or as two hemispherical pressure vessels joined by welding.

The spherical body 221 includes a first inlet port 223 connected to the recirculation water line 210. The spherical body 221 also includes a second inlet port 224 connected to the main bypass line 120. In the present exemplary embodiment, an internal distribution pipe 225 is disposed in the second inlet port 224 for distributing feed-water into the cavity 222.

The internal distribution pipe 225 includes a plurality of holes 225*a* directed only towards the center of the cavity 222.

The mixing element 220 also includes an access port 226, which allows manway access from outside of the mixing element 220 to the internal cavity 222. In one exemplary embodiment, the access port 226 is sufficiently large to allow a human to easily access the various components within the cavity 222. In one exemplary embodiment, the access port is sealed by a water and pressure tight hatch 227, which may be easily and repeatedly sealed and unsealed. The hatch 227 may be any of several configurations as would be known to one of ordinary skill in the art. In one exemplary embodiment, the access port is about 16 inches in diameter.

The mixing element 220 includes an outlet port 228 configured to allow the removal of liquid from the cavity 222. An internal debris filter 229 may be disposed over and substantially covering the outlet port 228. Alternative exemplary embodiments also include configurations wherein the debris filter 229 is disposed within the outlet port 228. In one exemplary embodiment, the debris filter 229 is configured to be removable from the cavity 222 via the access port 226 and hatch 227. In one exemplary embodiment, the debris filter 229 includes in its construction an internal perforated plate (not shown) in order to prevent particulate from flowing therethrough. In one exemplary embodiment, the debris filter 229 may be removable in one piece. Alternative exemplary embodiments include configurations wherein the debris filter 229 utilizes alternative filtering mechanisms as would be apparent to one of ordinary skill in the art.

A mixed feed-water line 230 is connected to the outlet port 228 of the mixing element 220 and the economizer feed-water line 130. A circulation pump 240 for pumping mixed feed-water therethrough is disposed along the length of the mixed feed-water line 230. In one exemplary embodiment the mixed feed-water line 230 includes a circulation pump stop valve 231 disposed between the mixing element 220 and the circulation pump 240. In one exemplary embodiment, the mixed feed-water line 230 may also include a minimum inlet flow control valve 232 disposed downstream of the circulation pump 240 and a stop valve 233 disposed downstream of the minimum inlet flow control valve 232 and upstream of the economizer feed-water line 130.

While one exemplary embodiment of a power plant 100 has been described above, it will be readily apparent that the exemplary embodiment of a mixing element 220 may be applied to a wider variety of different applications wherein the mixing of two liquids having different temperatures is desired.

An exemplary embodiment of the operation of the exemplary embodiment of a power plant 100 is described below. Referring now to FIGS. 1-3, when the power plant 100 is operating at start-up conditions or at low operating load conditions, the feed-water into the waterwalls 150 of the boiler (not shown) may not be of sufficient quantity to protect the waterwall tubes from overheating due to the combustion of fuel taking place in the boiler furnace. The introduction of relatively cold feed-water into the waterwalls 150 may have undesirable consequences such as metal fatigue in the waterwalls 150 due to thermal shock, or reduced power plant efficiency. Therefore, a recirculation system 200 is included to provide sufficient flow to the waterwalls and to pre-heat the incoming feed water before its introduction into the economizer 140.

When the power plant 100 is operating at start-up conditions or at low operating loads, feed-water is directed from the main feed-water line 110 to the main bypass line 120, through the inlet check valve 121 and into the mixing element 220. The relatively cold feed-water is then distributed in the cavity 222 of the spherical body 221 by the distribution pipe 225. The holes 225*a* in the distribution pipe 225 are directed only at the center of the cavity 222.

Meanwhile, saturated water from the separator 160 and storage tank 170 is recirculated by introduction into the mixing element 220 via the recirculation water line 210 and the first inlet port 223. This saturated water is relatively hot compared with the feed-water coming from the distribution pipe 225, however, the mixing element 220 is prevented from receiving a thermal shock due to the configuration of the holes 225*a* in the distribution pipe 225. The holes 225*a* ensure that the relatively cold feed-water and the relative hot recirculated water are combined in the center of the cavity 222 prior the contacting an interior surface of the body 221.

The recirculated water and the feed-water are thereby mixed to form a mixed feed-water having a temperature between the temperature of the saturated water and the temperature of the feed-water. The mixed feed water is then passed through the filter 229 and out of the mixing element 220 via the outlet port 228. The filter 229 removes any particulate accumulated by the recirculated water as it passed through the waterwalls 150 and any other debris entering through inlet port 223 from various other power plant 100 components.

The mixed feed-water is then passed to the circulation pump 240 along the mixed feed-water line 230. The combination of the circulation pump 240 and the inlet flow control valve 232 ensures that the mixed feed-water has the proper pressure for introduction into the economizer feed line 130. When the power plant 100 is operating at start-up or low operational load conditions the inlet check valve 121, the recirculation check valve 211, the recirculation stop valve 212, the circulation pump stop valve 231, the minimum inlet flow control valve 232 and the stop valve 233 may all be disposed in an open configuration, thereby allowing main feed-water to flow from the main feed-water line 110 to the mixing element 220, allowing recirculated saturated water to flow from the storage tank 170 to the mixing element 220, and allowing mixed feed-water to flow to the economizer feed-water line 130.

The mixed feed-water then flows along the economizer feed-water line 130 and is introduced into the economizer 140. Because the mixed feed-water is preheated, the economizer 140 can raise the temperature of the mixed feed-water to the appropriate temperature for introduction into the waterwalls 150 of the boiler (not shown). In one exemplary embodiment, substantially all of the feed-water from the main feed-water line 110 is diverted through the main bypass line 120; in another exemplary embodiment, only a portion of the main feed-water in the main feed-water line 110 is diverted to be pre-heated in the start-up system 200. In the later exemplary embodiment, the mixed feed-water is combined in the economizer feed-water line 130 with the relatively cold feed-water, which was not diverted through the start-up system 200.

During start up and low load operation, the mixed feed-water is converted to a steam/liquid water mixture in the waterwalls 150. This mixture is then sent to the separator 160 wherein the liquid water is separated from the steam. The steam is sent on to other elements of the power plant 100, such as a superheater (not shown) while the saturated liquid water is collected and stored in a storage tank 170. The saturated water is then introduced into the mixing element 220 and the cycle repeats.

At peak or moderate operational loads the feed-water provides sufficient flow to the waterwalls to protect the waterwall tubes from overheating, due to the combustion of fuel taking place in the boiler furnace. Therefore, the recirculation system 200 may be isolated from the rest of the power plant 100, e.g., the inlet check valve 121, the recirculation check valve 211, the recirculation stop valve 212, and the stop valve 233 may all be disposed in a closed configuration, thereby preventing main feed-water from flowing to the mixing element 220, and preventing any recirculated saturated water from flowing from the storage tank 170 to the mixing element 220. In one exemplary embodiment, the minimum inlet flow control valve 232 may be put into an assigned, partially open position for this mode of boiler operation. In addition, main feed-water may flow directly from the main feed-water line 110 to the economizer feed-water line 130.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A start-up system mixing element comprising:

a body defining a cavity;

a first inlet port disposed in the body and configured to provide a first fluid to the cavity;

a second inlet port disposed in the body and configured to provide a second fluid to the cavity;

an outlet port disposed in the body and configured to remove the first and second fluids from the cavity; wherein the body and the cavity are substantially spherical; and an internal distribution pipe disposed in the first inlet port, wherein the internal distribution pipe is configured to provide the first fluid to the cavity via a plurality of holes directed toward a center of the cavity in a manner effective to combine the first fluid and the second fluid in the center of the cavity prior to contacting an interior surface of the body.

2. The start-up system mixing element of claim 1, further comprising a debris filter disposed within the cavity and covering the outlet port.

3. The start-up system mixing element of claim 1, further comprising an access port disposed in the body and configured to provide manway access to the cavity.

4. The start-up system mixing element of claim 3, wherein the debris filter is configured to be removable from the cavity via the access port.

5. The start-up system mixing element of claim 3, further comprising a water and pressure tight hatch disposed in the access port.

6. The start-up system mixing element of claim 5, wherein the hatch is configured to be repeatedly sealed and unsealed.

7. The start-up system mixing element of claim 1, wherein the plurality of holes in the internal distribution pipe are directed only toward a center of the cavity.

8. A power plant comprising:

a main feed-water line;

a main bypass line connected to the main feed-water line;

an economizer feed-water line connected to the main feed-water line;

an economizer connected to the economizer feed-water line;

a plurality of waterwalls connected to the economizer;

a separator connected to the waterwalls and configured to separate liquids from steam;

a recirculation water line configured to receive liquids from the separator;

a start-up system mixing element connected to the main bypass line and the recirculation water line;

a mixed feed-water line connected to the start-up system mixing element and the economizer feed-water line; and a circulation pump disposed along the mixed feed-water line between the start-up system mixing element and the economizer feed-water line, wherein the start-up system mixing element comprises:

a body defining a cavity; wherein the body and the cavity are substantially spherical;

a first inlet port disposed in the body and configured to receive a first fluid from the main bypass line and provide the first fluid to the cavity;

a second inlet port disposed in the body and configured to receive a second fluid from the recirculation water line and provide the second fluid to the cavity;

an outlet port disposed in the body and configured to remove the first and second fluids from the cavity;

an access port disposed in the body and configured to provide manway access to the cavity; and an internal distribution pipe disposed in the first inlet port, wherein the internal distribution pipe is configured to provide the first fluid to the cavity via a plurality of holes directed toward a center of the cavity.

9. The power plant of claim 8, wherein the start-up system mixing element further comprises a debris filter disposed within the cavity and covering the outlet port.

10. The power plant of claim 9, wherein the start-up system mixing element further comprising an access port disposed in the body and configured to provide manway access to the cavity.

11. The power plant of claim 10, wherein the debris filter is configured to be removable from the cavity via the access port.

12. The power plant of claim 9, wherein the debris filter includes a perforated plate.

13. The power plant of claim 8, wherein the plurality of holes in the internal distribution pipe are directed only toward a center of the cavity.

14. The power plant of claim 8 further comprising:

a first stop valve disposed in the main feed-water line upstream of the main bypass line;

an isolation valve disposed in the main feed-water line upstream of the main bypass line;

a first check valve disposed in the economizer feed-water line upstream of the economizer;

a second check valve disposed in the recirculation water line upstream of the start-up system mixing element;

a second stop valve disposed in the recirculation water line upstream of the start-up system mixing element;

a third stop valve disposed in the mixed feed-water line upstream of the circulation pump;

an inlet flow control valve disposed in the mixed feed-water line upstream of the economizer feed-water line; and a fourth stop valve disposed in the mixed feed-water line upstream of the economizer feed-water line.

15. The power plant of claim 8, further comprising a storage tank connected to the separator and the recirculation water line.

16. A method for mixing and filtering two fluids, the method comprising:

providing a body defining a cavity; wherein the body and the cavity are substantially spherical;

providing a first fluid to the cavity via a first inlet port disposed in the body;

providing a second fluid to the cavity via a second inlet port disposed in the body; and mixing the first and second fluids in the center of the cavity before the fluids contact the body.

17. The method of claim 16, further comprising filtering the mixed first and second fluids through a filter.

* * * * *

UNITED STATES PATENT AND TRADEMARK OFFICE

CERTIFICATE OF CORRECTION

PATENT NO. : 8,230,686 B2
APPLICATION NO. : 12/248452
DATED : July 31, 2012
INVENTOR(S) : John M. Banas and Vincent J. Costa It is certified that error appears in the above-identified patent and that said Letters Patent is hereby corrected as shown below:

On the title page insert item -- (73) Assignee: ALSTOM Technology Ltd (CH) --

Signed and Sealed this
Eighteenth Day of December, 2012

David J. Kappos

David J. Kappos
*Director of the United States Patent and Trademark Office*